United States Patent [19]

Keep, Jr. et al.

[11] 4,388,523

[45] Jun. 14, 1983

[54] ELECTRICAL HEATING CABLE CONNECTOR

[75] Inventors: Henry Keep, Jr., Madison; Daniel A. Santagata, Branford; Matthew E. Harris, Clinton; William H. Welsh, Jr., Madison, all of Conn.

[73] Assignee: Multistress, Inc., Madison, Conn.

[21] Appl. No.: 272,260

[22] Filed: Jun. 10, 1981

[51] Int. Cl.[3] ..... H05B 3/08

[52] U.S. Cl. ..... 219/541; 174/77 R; 174/93; 219/535; 219/544

[58] Field of Search ..... 219/528, 535, 541, 544, 219/549; 338/174; 174/73 R, 77 R, 93; 246/428; 339/89 M

[56] References Cited

U.S. PATENT DOCUMENTS

| | | | |
|---|---|---|---|
| 3,054,847 | 9/1962 | Colbert | 174/93 X |
| 3,084,210 | 4/1963 | Bluth et al. | 174/77 R X |
| 3,104,275 | 9/1963 | Palmieri | 174/77 R X |
| 3,487,160 | 12/1969 | Johnsen | 174/93 X |
| 3,609,639 | 9/1971 | Lind | 339/89 M |
| 3,692,922 | 9/1972 | Sugimoto et al. | 174/73 R |
| 3,774,013 | 11/1973 | Keep, Jr. | 219/535 |
| 4,069,410 | 1/1978 | Keep, Jr. | 219/535 |
| 4,195,805 | 4/1980 | Keep, Jr. | 246/428 |

FOREIGN PATENT DOCUMENTS

| | | | |
|---|---|---|---|
| 1440855 | 11/1968 | Fed. Rep. of Germany | 174/93 |

*Primary Examiner*—Volodymyr Y. Mayewsky
*Attorney, Agent, or Firm*—Albert C. Johnston

[57] ABSTRACT

A connector for joining an end of an electrical resistance heating wire of an electrical heating cable enclosed in water-tight tubing with an end of the wire of an insulated electrical conductor comprises a heat-absorbing electrically conductive core member to receive and be clamped onto the wire ends, a rigid sleeve forming an elongate cavity to receive the core member with the wire ends fastened thereto, electrical insulation inside the sleeve between it and the core member and the wire ends, and a coupling ring fixed onto each end of the sleeve, one of the coupling rings having structures connected to it for clamping it substantially immovably onto an end portion of the cable-enclosing tubing and the other coupling ring having structures connected to it for forming a substantially water-tight joint between it and the insulated conductor.

9 Claims, 4 Drawing Figures

ELECTRICAL HEATING CABLE CONNECTOR

This invention relates to a connector device for joining an end of a length of electrical heating cable with an insulated conductor for supplying current through the cable length.

A connector according to the invention is particularly useful, for example, for joining an end of the electrical resistance heating wire ("hot wire") of such a cable length enclosed within tubing with the wire ("cold wire") of an insulated electrical conductor so that the joint not only makes an efficient electrical connection between the wires but, in addition, prevents harmful conduction of heat from the hot wire to the insulated conductor, adapts itself to the thermal contractions and expansions which occur when the cable heats up and cools, enables quick disconnection or reconnection of either of the wires whenever required, as for removal or replacement of the heating cable, and, moreover, enables the joint to be made water-tight to avoid hazards of a short circuit being caused by water or other liquid that may be present where the connector is to be used.

A connector for an electrical heating cable as provided by this invention comprises a heat-absorbing electrically and thermally conductive core member that receives and is clamped onto an end of the heating cable wire and an end of the wire of the insulated conductor, and is enclosed in electrically insulating material confined inside a sleeve having a coupling ring fixed onto each of its ends. A cap ring is fixed onto an end of a length of tubing that encloses the heating cable and is joined with one of the coupling rings, as by forming a compression joint between the tubing and a pliable ring fitted inside the cap ring as the cap ring is screwed onto one of the coupling rings. A collar fitted over the insulated conductor is joined with the other coupling ring, as by being screwed onto it and thus compressing against its end and against the insulated conductor an elastic bushing confined inside the collar. The collar advantageously is connected with the end of a protective flexiable shield extending from it along a region of the insulated conductor near the connector to limit bending and prevent abrasion of the insulation of the conductor.

According to another feature of the invention, a region of the connector extending inside the sleeve from the elastic bushing to the core member is filled with a heat-resistant flexible insulating compound, such as a flowable silicon compound, to enhance the thermal and insulating properties and watwr-tightness of the joint Thus, a water-tight connector is provided that electrically joins ends of the cold and hot wires; absorbs and dissipates heat from the hot wire end so as to prevent excessive heating of the insulated conductor; accommodates the thermal expansions and contractions that occur with heatings and coolings of the hot wire; and by excluding water prevents access to the wires of liquid that could cause leakage of current or even a short circuit from the hot wire to the metal sheath or other conductive confinement of the heating cable. Yet the construction of the connector enables easy disconnection and displacement of the coupling rings and of the sleeve with the insulating material inside it for access to the conductive core member clamped onto the wire ends, whereupon either or both of the wire ends can be readily released, or re-engaged, for removal or replacement of the heating cable or the insulated conductor.

The above mentioned and other objects, features and advantages of the invention will be further evident from the following description and the accompanying drawings of an illustrative embodiment of the invention. In the drawings.

Figures 1, 2, 3, 4:
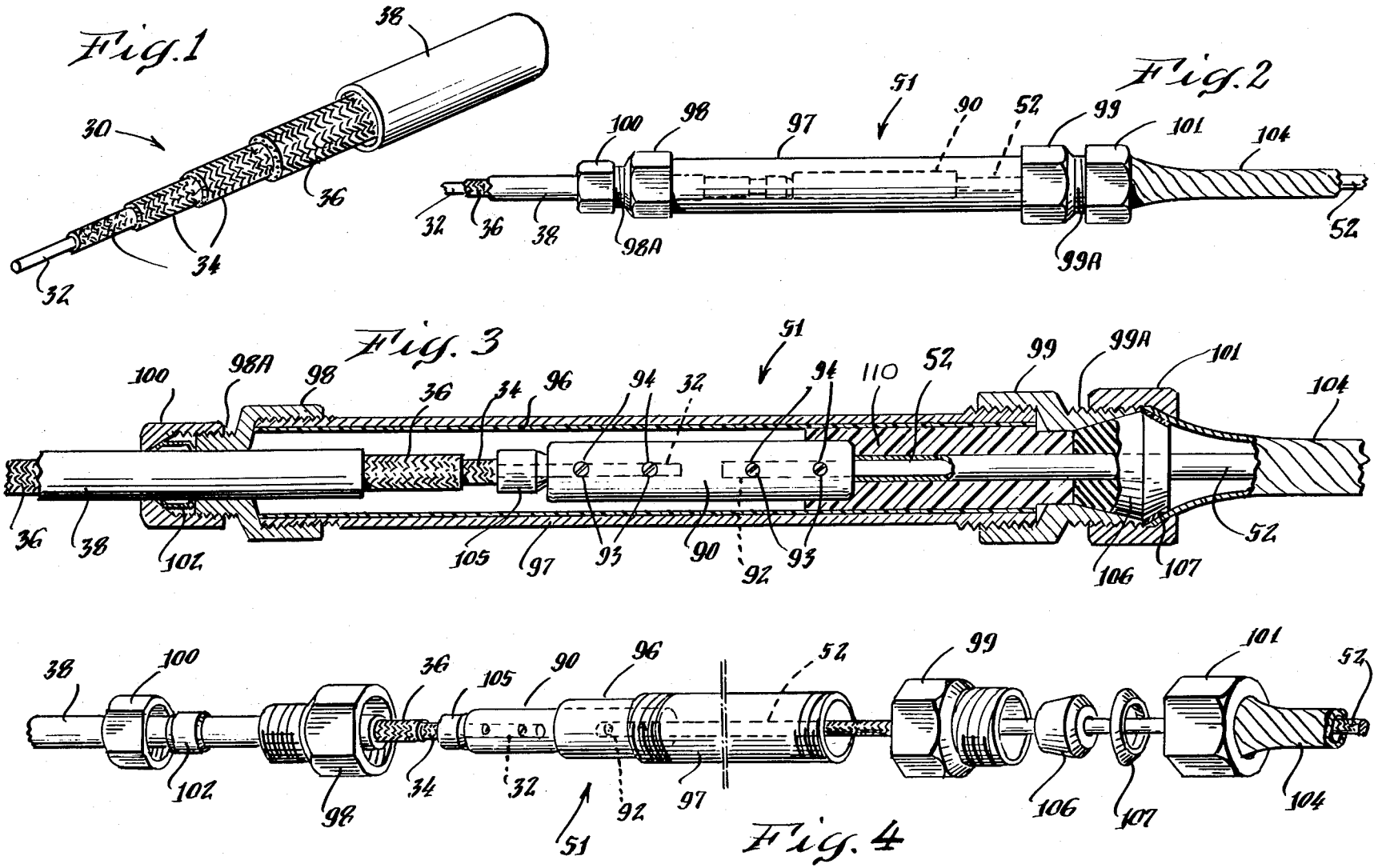
FIG. 1 is a schematic perspective view of components of an electrical heating cable for which the connector of the invention is suited, with an enclosing tubing length fitted over the cable.
FIG. 2 is an elevational view of a connector according to the invention joining an end of a heating cable length and tubing enclosing it with an insulated current conductor.
FIG. 3 is a longitudinal cross-sectional view of the connector assembly.
FIG. 4 is a perspective view of the connector assembly in partially disassembled condition.

A typical use of electrical heating cable connectors according to the present invention is for joining the ends of heating cable lengths with insulated conductors in a railroad switch heating system such as that disclosed in U.S. Pat. No. 4,195,805 and, more particularly, for making such connections in electrical heating apparatus or devices in which a length of heating cable is made water-tight by being enclosed in tubing as disclosed in a copending application Ser. No. 267,791 filed May 28, 1981.

FIG. 1 of the drawings shows schematically an end of a length of electrical heating cable 30 enclosed inside a length of water-impervious tubing 38. The cable 30 typically is of the kind disclosed in U.S. Pat. No. 3,774,013. It comprises a core wire 32 that is a single solid strand of high temperature electrical resistance heating wire, with a sheath 34 of highly heat resistant electrically insulating material braided on the wire and confined inside a thermally conductive shielding layer 36, or outer sheath, of heat-resistant wire braided upon the insulating sheath. The core wire 32, for instance, is a No. 12 gauge wire of a nickel-chromium alloy, such as the alloy of 80% nickel and 20% chromium known as Nichrome, having a diameter for instance of about 0.081". The electrically insulating sheath 34 may be formed of several layers of a ceramic fiber, typically three layers, braided one over another onto the wire core 32. The shielding layer 36 confining the insulating material 34 is a pliable sheath composed of a metal highly resistant to heat, abrasion and oxidation, and may be formed by braiding wires of a copper-nickel alloy such as INCONEL into a sleeve fitting tightly on the insulating sheath. The cable enclosing tubing 38 may be, for instance, a bendable metal tube such as a length of extruded aluminum tubing having, for example, an inside diameter of about 0.5" and a wall thickness of about 0.05". The tubing length 38 is substantially coextensive with the cable length enclosed in it. By excluding water from access to the heating cable 30 the tubing 38 prevents current losses, short circuit or burn-out from being caused by water or other liquid that otherwise might be accessible to the cable.

The risk of water causing a failure of the heating cable at or near the joint between an end of its hot wire 32 and the end of an insulated conductor for supplying electrical current to the cable is overcome by a connector device 51 in accordance with the present invention, a preferred form of which is shown in FIGS. 2, 3 and 4. This device connects a bared end of the core ("hot")

wire 32 of the length of cable 30 with a bared end of the "cold" wire 92 of an insulated conductor 52 in a circuit for supplying heating current to the cable length. The insulated conductor 52 may be, for instance, a No. 8 gauge, highly conductive wire encased in a jacket of silicone rubber or rubber-like insulation. The current source typically will supply a 110 V or 220 V AC current to the electrical resistance wire 32 at a current density of, for example, 20 to 40 or more watts per square inch, thus generating enough heat to bring the wire 32 to a temperature, for instance, of about 1250° F. at an ambient temperature of 0° F.

The connector 51 as shown comprises a tubular core member 90 of electrically and thermally conductive metal, such as brass or copper, which serves as a heat sink. The bared end of wire 32 of the cable 30 is inserted into and fastened in one end of member 90, and the bared end of wire 92 of the insulated conductor 52 is inserted into and fastened in the other end of member 90. The core member 90 may be crimped so as to clamp the wire ends permanently in place. Preferably, however, member 90 is made of brass and is formed with screw-threaded radial bores 93 in which set screws 94 are fitted so that the wire ends will be clamped releasably in place by the screws, thus enabling quick disconnection and removal, or quick connection, of either of the wire ends whenever desired for disassembly or assembly of the joint formed by the connector.

The tubular core member 90 with the wire ends attached is enclosed in a surrounding electrical insulator 96 of heat resistant insulation, such for instance as a tube of "Teflon" about 1/16" thick, and the insulation in turn is confined inside a rigid sleeve 97 which has coupling rings 98 and 99 fixed onto its ends. The sleeve 97, for instance, is a 6½" long piece of aluminum tubing having an inside diameter of about 9/16", and is externally screw-threaded at each of its ends. Each of the coupling rings 98 and 99 is internally threaded so as to screw onto one of the sleeve ends, and has an externally threaded shank 98A or 99A for connecting it with an internally threaded cap ring 100, or with a screw collar 101.

The cap ring 100 receives a compressible ring 102 that fits onto an end portion of the tubing 38 enclosing the heating cable 30. Cap ring 100 is fastened to the tubing end by compressing the ring 102 inside it onto the tubing as ring 100 is screwed onto the shank 98A of coupling ring 98.

The screw collar 101 is coupled with the end of a spiral shield 104 that fits over and extends along a portion of the insulated conductor 52 near the connector 51 so as to protect the conductor 52 from injury by limiting access to it and limiting the angle to which it can be bent when assembled with the connector.

An insulating heat resistant elastic bushing 106, made for example of a material such as Neoprene, and an adjacent washer 107, both of which fit inside the collar 101, are fitted onto the insulated conductor 52 near its bared end so that the bushing 106 will be pressed and sealed against the insulation of conductor 52 and against an inner surface of the shank 99A of coupling ring 99 when the collar 101 is screwed into engagement with ring 99.

An insulating ceramic bead 105 that can be slid through the coupling ring 98 is fitted over the bared end of the heating wire 32 up to the insulation 34 thereon before this wire end is fastened in the core member 90. The ceramic bead 105 then holds the end of cable sheath 36 away and insulated from the wire and member 90.

Preferably, at least an end portion of the core member 90 and the length of the insulated conductor 52 extending to member 90 inside the sleeve 97 and coupling ring 99 is embedded in a mass 110 of a flexible silicone sealing compound to prevent moisture from entering the connector yet permit expansion and contraction of the core member 90 and the joined wires. The sealing compound can be extruded into the end of sleeve 97 and ring 99 and then confined in place by bushing 106 when this bushing is pressed in place by washer 107 and the coller 101.

By virtue of the described construction, the connector 51 makes a secure yet readily separable electrical connection between the bared ends of the "hot" wire 32 and a "cold" wire 92 of the electrical heating circuit, while accommodating the thermal expansions and contractions of the wires and connector parts, serving effectively as a heat barrier to prevent injurious flow of heat from the hot wire to the insulated conductor and, in addition, rendering the electrical joint substantially water-tight so that it will not be affected by water or other liquid at the location of its use.

Whenever it is desired to disconnect the heating cable or the conductor, this can be accomplished quickly, for instance, by detaching the coupling rings 98 and 99 and the collar 101, sliding the collar 101 and spring shield 104 away from the coupling ring 99, sliding this ring and the sleeve 97 with the insulation 96 and 110 inside it off the core member 90, and turning set screws 94 to release the wire end for removal from the core member. Quick reconnection of a wire end of course can be effected by reversal of the steps.

For initial assembly of the connector with the heating cable and the insulated conductor, the cap ring 100, compressible ring 102 and coupling ring 98 may first be slid onto the end of tubing 38 with parts of the cable sheath 36, cable insulation 34 and resistance wire 32 protruding from the tubing end. The ceramic bead 105 may then be slid onto the bared end of wire 32, and that wire then fastened in place in conductive core member 90. The bared end of the cold wire 92 may then be fastened into the core member, other parts of the connector having previously been slid onto the insulated conductor. Then the sleeve 97 with insulator 96 fitted inside it may be slid over the joined wire ends and coupled with ring 98, before or after which cap ring 100 may be screwed onto the shank 98A of ring 98 so as to compress ring 102 tightly against the tubing 38. With the sleeve 97 thus in place, coupling ring 99 may be screwed onto it, and a silicone sealing compound then injected into the cavity of sleeve 97 and ring 99 so as to fill that cavity at least up to the location of the core member 90, for instance as indicated at 110 in FIG. 3. Then the elastic bushing 106 may be slid into place inside shank 99A of ring 99 and the collar 101 screwed onto shank 99A so that the washer 107 inside collar 101 will compress bushing 106 against the sealing compound, the coupling ring and the insulated conductor. If desired, the conductive core member 90 and ceramic bead 105 may be dimensioned relative to the ring elements 98, 102 and 100 so that the wire ends may be fastened in place in core member 90, followed by sliding movement of the cap ring 100, compressible ring 102 and coupling ring 98 over the core member and the bead to the desired location of these elements on the end of the cable-enclosing tubing 38.

While a particular form of a heating cable connector according to the invention has been illustrated in the drawings and described hereinabove, it will be evident to persons skilled in the art that this invention may be employed in other forms or ways, and by use of parts differing in form or in manner of connection from those of the illustrated embodiment, while still utilizing the substance of the invention herein disclosed and defined by the claims.

What is claimed is:

1. A connector for joining an end of an electrical resistance heating wire of an electrical heating cable enclosed in water-tight tubing with an end of the wire of an insulated electrical conductor, comprising a heat-absorbing electrically conductive core member to receive and be clamped onto the wire ends, a rigid sleeve forming an elongate cavity to receive said core member with the wire ends fastened thereto, electrical insulation inside said sleeve between it and the core member and the wire ends, a coupling ring fixed detachably onto each end of said sleeve, means connectable detachably with one of the coupling rings for clamping it substantially immovably onto an end portion of said tubing, and means associated with the other of the coupling rings for forming a substantially water-tight joint between it and the insulated conductor.

2. A connector according to claim 1, said core member comprising an elongate body of brass or copper having at each of its ends a cavity extending therein to receive one of said wire ends and means on said body for tightly yet releasably fastening each of said wire ends to said body.

3. A connector according to claim 2 for a said cable of which the heating wire is encompassed in electrically insulating material confined inside a braided wire sheath, said connector further comprising an insulating ceramic bead fitting onto a bared portion of said heating wire adjacent to an end of said core member body to isolate the heating wire and said body from said sheath.

4. A connector according to claim 1, 2, or 3, said clamping means comprising a cap ring slid onto said tubing end portion, a compressible ring slid thereonto and fitting inside said cap ring, coengaging means on said cap ring and said one coupling ring for joining the same together and thereby causing means inside said cap ring to force said compressible ring into binding engagement with said tubing.

5. A connector according to claim 1, 2, or 3, said joint forming means comprising a collar slid onto said insulated conductor, a heat resistant elastic bushing slid thereonto and fitting inside said collar, and coengaging means on said collar and said other coupling ring for joining the same together and thereby causing means inside said collar to force said bushing into sealing engagement with said conductor and with an end portion of said other coupling ring.

6. A connector according to claim 5, said collar being coupled with an end of a flexible spiral shield fitted over and extending along a portion of said conductor directed away from the connector to limit bending of and shield the conductor near the connector.

7. A connector according to claim 5, said sleeve and said other coupling ring having a mass of flexible heat resistant insulating and sealing compound filled into the space thereof about said conductor between said bushing and said core member.

8. A connector according to claim 7, said compound being a silicone sealing compound extruded into said space.

9. A connector according to claim 4, said joint forming means comprising a collar slid onto said insulated conductor, a heat resistant elastic bushing slid thereonto and fitting inside said collar, and coengaging means on said collar and said other coupling ring for joining the same together and thereby causing means inside said collar to force said bushing into sealing engagement with said conductor and with an end portion of said other coupling ring; said collar being coupled with an end of a flexible spiral shield fitted over and extending along a portion of said conductor directed away from the connector to limit bending of and shield the conductor near the connector; said sleeve and said other coupling ring having of a mass of flexible heat resistant insulating and sealing compound filled into the space thereof about said conductor between said bushing and said core member.

* * * * *